US006691686B2

(12) United States Patent
Klas et al.

(10) Patent No.: US 6,691,686 B2
(45) Date of Patent: Feb. 17, 2004

(54) INTAKE MANIFOLD WITH IMPROVED EXHAUST GAS RECIRCULATION

(75) Inventors: Jeffrey J. Klas, Brighton, MI (US); Lakhi N. Goenka, Ann Arbor, MI (US); Mark D. Miller, Monroe, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/040,956

(22) Filed: Dec. 28, 2001

(65) Prior Publication Data

US 2003/0121508 A1 Jul. 3, 2003

(51) Int. Cl.[7] ..... F02M 25/07
(52) U.S. Cl. ..... 123/568.17; 123/184.21
(58) Field of Search ..... 123/568.17, 184.21, 123/184.24, 184.34, 184.35, 184.36, 184.42, 184.43, 184.44, 184.47, 184.48, 184.49

(56) References Cited

U.S. PATENT DOCUMENTS

| | | | | |
|---|---|---|---|---|
| 4,327,698 A | | 5/1982 | Hamai et al. | |
| 4,445,487 A | * | 5/1984 | Higashi | 123/568.17 |
| 4,513,698 A | | 4/1985 | Senga et al. | |
| 4,697,569 A | | 10/1987 | Hertweck et al. | |
| 4,741,295 A | | 5/1988 | Hosoya et al. | |
| 4,867,109 A | | 9/1989 | Tezuka et al. | |
| 5,207,714 A | * | 5/1993 | Hayashi et al. | 123/568.17 |
| 5,329,912 A | | 7/1994 | Matsumoto et al. | |
| 5,427,080 A | | 6/1995 | Maeda et al. | |
| 5,542,711 A | * | 8/1996 | Vaudry | 285/41 |
| 6,138,651 A | | 10/2000 | Mori et al. | |
| 6,155,223 A | | 12/2000 | Miazgowicz | |
| 6,167,865 B1 | | 1/2001 | Ma | |

FOREIGN PATENT DOCUMENTS

| | | |
|---|---|---|
| EP | 0727572 A1 | 8/1996 |
| JP | 2002 89376 A | 3/2002 |

* cited by examiner

*Primary Examiner*—Henry C. Yuen
*Assistant Examiner*—Hyder Ali
(74) *Attorney, Agent, or Firm*—Brinks Hofer Gilson & Lione

(57) ABSTRACT

Intake manifolds for an internal combustion engine and methods of using the same are disclosed. The intake manifolds accommodate the introduction of exhaust gas that has been recirculated from the main exhaust gas stream. The exhaust gas can be introduced into the intake manifold through aerodynamically shaped members that are located inside the manifold. Alternatively, the exhaust gas can be introduced into the manifold at or near the intersection of the primary runners and the plena, or the exhaust gas can be introduced into a mixing chamber located between the primary runners and the plena.

4 Claims, 3 Drawing Sheets

INTAKE MANIFOLD WITH IMPROVED EXHAUST GAS RECIRCULATION

BACKGROUND OF THE INVENTION

The present invention relates generally to a means for recirculating exhaust gas through an engine.

Exhaust gas is commonly recirculated through an internal combustion engine in order to improve the exhaust gas quality and fuel efficiency of the engine. In general, a portion of the exhaust from the engine is siphoned off the main exhaust stream downstream of the engine and re-routed to a location upstream of the engine where it is mixed with the fresh air supply. The mixture of fresh air and the recirculated exhaust gas is then supplied to the engine. The degree to which fuel efficiency and exhaust gas quality of the engine are improved depends on, among other things, the location where the exhaust gas is injected into the fresh air stream and the manner in which it is injected.

One possible location for introducing the exhaust gas into the fresh air stream is to inject the exhaust gas at some point on the intake manifold. The are myriad possible locations on an intake manifold where the exhaust gas can be injected, and the resultant improvements in fuel efficiency and exhaust gas quality are equally varied. The flow conditions vary greatly throughout an intake manifold and significantly affect the degree to which the exhaust gas is mixed with the fresh air coming into the system. If the exhaust gas and the fresh air are not thoroughly mixed, the full benefits of exhaust gas recirculation (EGR) are not realized. The present invention provides an improved system for injecting exhaust gas into an intake manifold that seeks to improve the mixing of recirculated exhaust gas and fresh air, and maximize the benefits of EGR.

BRIEF SUMMARY OF THE INVENTION

Intake manifolds for an internal combustion engine are provided. In a first embodiment the intake manifold comprises an air inlet; a plenum, the plenum being in fluid communication with the air inlet; at least one primary runner, the at least one primary runner being attached to and in fluid communication with the plenum; and an EGR inlet. The EGR inlet is located near the intersection of the at least one primary runner and the plenum. In a second embodiment, the intake manifold comprises an air inlet; a plenum in fluid communication with the air inlet; at least one primary runner, the at least one primary runner being in fluid communication with the plenum; a flange, the flange having a front side and a back side, wherein the front side of the flange faces the air inlet; and an EGR inlet. The EGR inlet is located on the flange. In a third embodiment, an intake manifold comprises an air inlet; a plenum, the plenum being in fluid communication with the air inlet; a mixing reservoir, the mixing reservoir being in fluid communication with the plenum; a plurality of primary runners, the plurality of primary runners being in fluid communication with the mixing reservoir; and an EGR inlet. The EGR inlet is located in the plenum. In a fourth embodiment, an intake manifold comprises an air inlet; a plenum; a secondary runner, the air inlet being in fluid communication with the plenum via the secondary runner; at least one primary runner, the at least one primary runner being in fluid communication with the plenum; a flow strut, the flow strut being located in the secondary runner; and an EGR inlet. The EGR inlet is located on the strut.

DETAILED DESCRIPTION OF THE INVENTION

Figure 1:
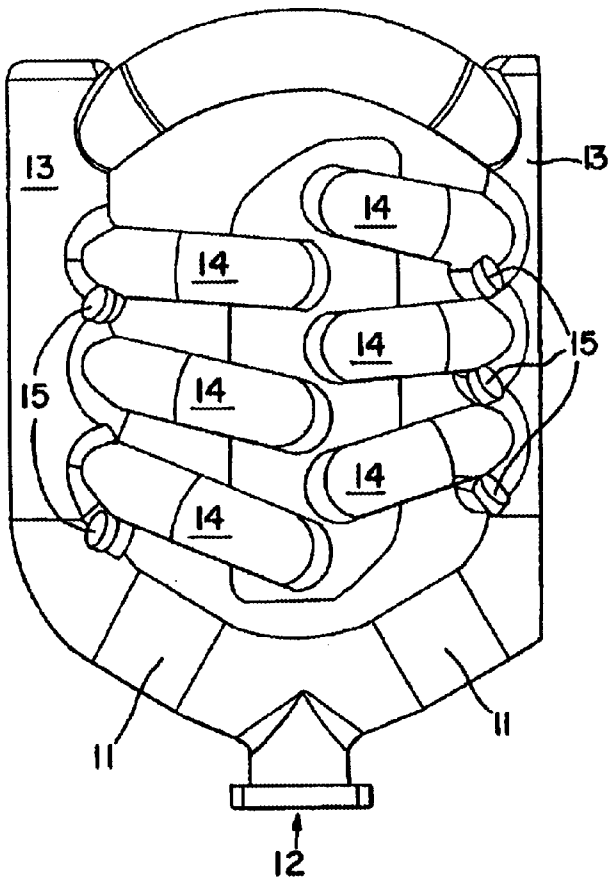
FIG. 1 is a top view of a first embodiment of an intake manifold according to the present invention.

The present invention may be applied to an intake manifold for any type or configuration of internal combustion engine. The exemplary embodiments shown in the drawings and described below are directed to a double-plenum intake manifold for an inline six-cylinder engine. The present invention could also be applied to, for example and without limitation, a single plenum intake manifold, an intake manifold for an engine with more or less than six cylinders, or an intake manifold for a V-type engine. The double-plenum intake manifold for an inline six-cylinder engine described herein is only illustrative of the claimed invention, and does not limit application of the present invention to manifolds for different engine configurations.

Any method of conveying exhaust gas from the main exhaust stream to the intake manifold may be used with the present invention. The method of withdrawing a portion of exhaust gas from the main exhaust stream and routing it back to the intake manifold does not limit the scope or application of the present invention.

The intake manifold of the present invention can be made of any material that is suitable for use with an internal combustion engine. The intake manifold is most preferably made of cast aluminum. The intake manifold of the present invention likewise can be made according to any method that is suitable for making an intake manifold for use with an internal combustion engine. The composition and manufacture of the intake manifold of the preferred embodiment do not limit the scope or application of the present invention.

Figure 2:
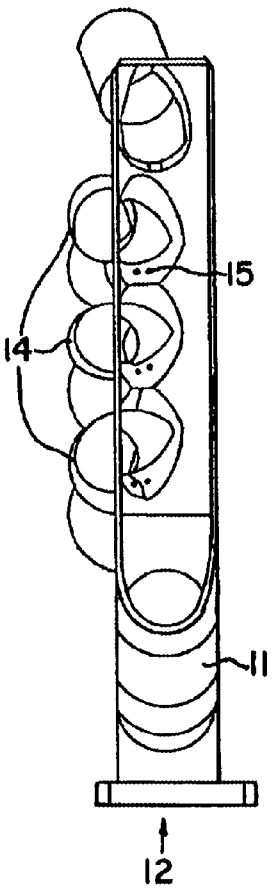
FIG. 2 is a side view of a first embodiment of the intake manifold of the present invention, wherein the wall of the plenum has been cut away.

FIGS. 1 and 2 show an intake manifold according to a first embodiment of the present invention. The intake manifold 10 includes a pair of secondary runners 11 that connect the air inlet 12 to the plena 13. The air inlet 12 is thus in fluid communication with the plena 13. A series of primary runners 14 connect the plena 13 to the cylinder heads (not shown) positioned approximately beneath the terminal end of each primary runner 14. Each plenum 13 collects the air and distributes it to the appropriate primary runner 14 as air is needed by the corresponding cylinder. EGR inlets 15 are located at or near the intersection of the primary runners 14 with the plena 13. The embodiment shown in FIG. 2 shows two EGR inlets 15 per primary runner 14. Alternatively, there could be only one EGR inlet 15 per primary runner, or more than two. In a preferred embodiment, the EGR inlets 15 are elliptical and have a major that is approximately 0.3 inches in diameter. Exhaust gas is fed through EGR inlets 15 by EGR tubes (not shown). EGR tubes supply the exhaust gas that has been siphoned off the main exhaust stream downstream of the engine.

In operation, air is fed to the intake manifold embodied in FIGS. 1 and 2 through inlet 12. The amount of airflow into the intake manifold is controlled by a throttle body (not shown) attached to the inlet 12. After entering the inlet 12, the air is routed through the two secondary runners 11 to the plena 13. The air is held in the plena 13 until the air is needed by one of cylinders. When air is needed by one of the cylinders, the air is drawn from the plenum 13 into the corresponding primary runner 14. The airflow from the plenum 13 into the primary runner 14 creates an area of low pressure near the intersection of the primary runner 14 with the plenum 13. Exhaust gas is injected into the area of low pressure through EGR inlet 15. The exhaust gas and fresh air mix in the area of low pressure and the resultant mixture flows through the primary runner 14 into the corresponding cylinder.

Figure 3:
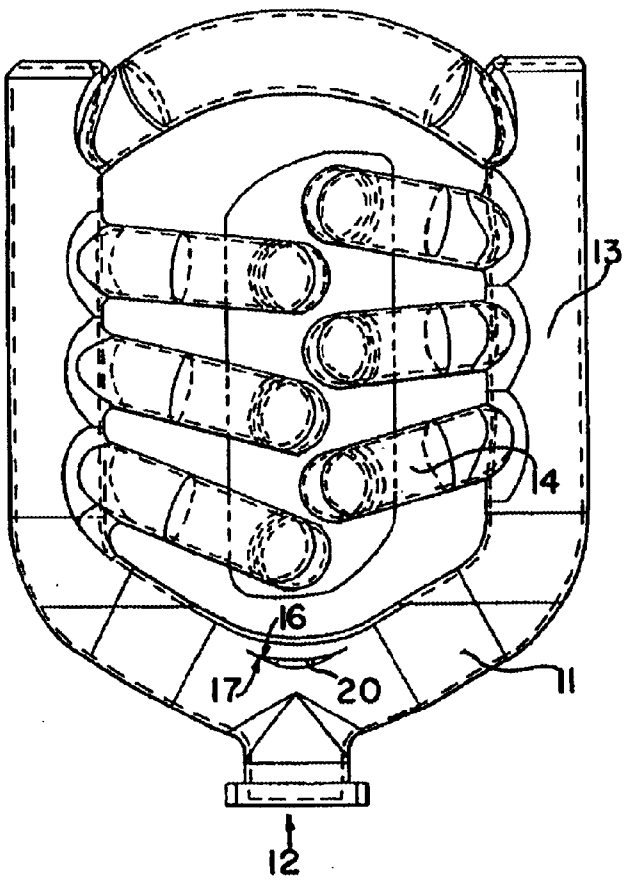
FIG. 3 is a top view of a second embodiment of an intake manifold according to the present invention.
Figure 4:
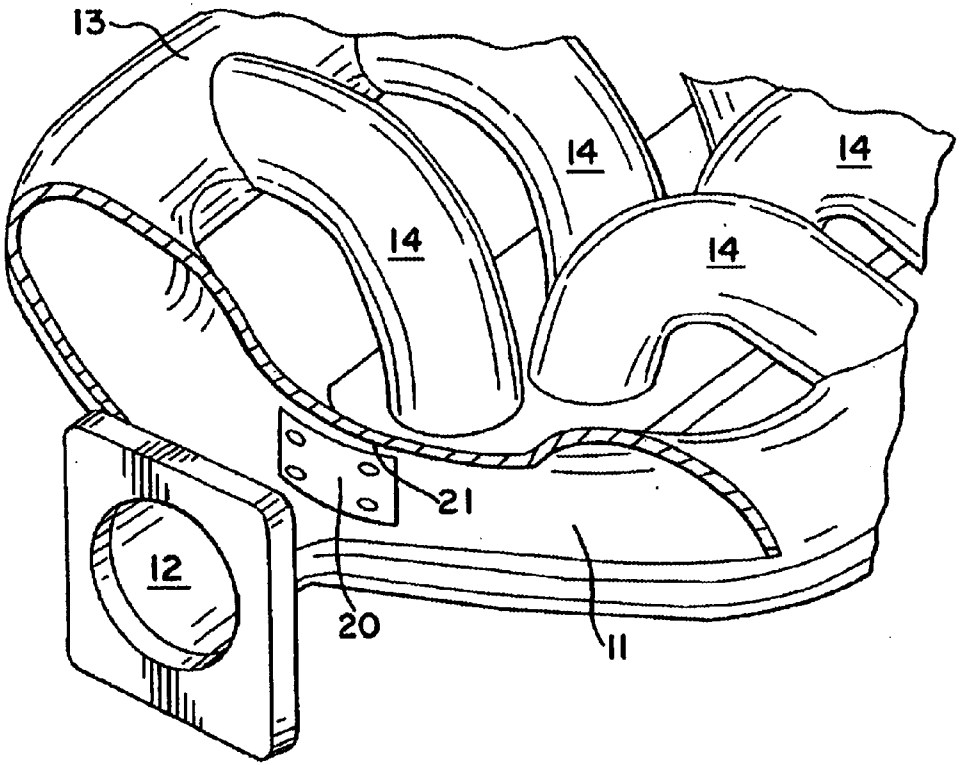
FIG. 4 is a perspective view of a second embodiment of the intake manifold according to the present invention, wherein the top portion of the secondary runners has been cut away.

FIGS. 3 and 4 show an intake manifold according to a second embodiment of the present invention. The intake manifold 10 includes a pair of secondary runners 11 that connect the air inlet 12 to the plena 13. The air inlet 12 is thus in fluid communication with the plena 13. A series of primary runners 14 connect the plena 13 to the cylinder heads (not shown). Each plenum 13 collects the gas to be fed to the cylinders and distributes it to the cylinders via primary runners 14. Positined within each of the secondary runners 11 is a flange 20. As shown, each flange 20 is located opposite from the air inlet 12 and spaced from the back wall of the secondary runners 11. Each flange 20 is an aerodynamic member and has a shape that causes as little disruption to the fluid flow as possible. In a preferred embodiment, flange 20 has a concave side 16 and a convex side 17, wherein the convex side 17 faces the air inlet 12. More preferably, the flange 20 extends the full height of the secondary runners 11. In the preferred embodiment of FIGS. 3 and 4, the concave side faces the back wall of the secondary runners 11. It can be appreciated, however, that in embodiments where there is a straight run between the air inlet 12 and the plenum 13, the concave side faces downstream rather than the back wall of the secondary runners 11. The important aspect of this preferred embodiment is that the convex side faces the air inlet 12. Preferably, the flange 20 has a radius of curvature of 10 inches and is 1 inch long. In a preferred embodiment, the flange 20 is made of stainless and is attached in the secondary runners 11 by an isolation fitting. Alternatively, the flange 20 can be cast with and constructed of the same material as the rest of the intake manifold. Flange 20 includes one or more EGR inlets 15. The EGR inlets are preferably 0.1 inch in diameter. The preferred embodiment shown in FIG. 4 includes four EGR inlets, however, there may be more or less than four EGR inlets. Preferably the exhaust gas is fed into flange 20 and through EGR inlets 15 by EGR tube(s) that enter the manifold from underneath the flange 20.

In operation, air is fed to the intake manifold embodied in FIGS. 3 and 4 through inlet 12. The amount of air fed to the intake manifold is controlled by a throttle body (not shown) attached to the inlet 12. After entering the intake manifold through inlet 12 the air flows around flange 20. Exhaust gas is injected into the manifold through EGR inlets 15. The exhaust gas and air are mixed together and flow through the secondary runners 11 to the plena 13. Preferably, as the cylinders of the engine need air, the mixture of exhaust gas and air is drawn from the plena 13 and is supplied to the appropriate cylinder through primary runners 14.

Figure 5:
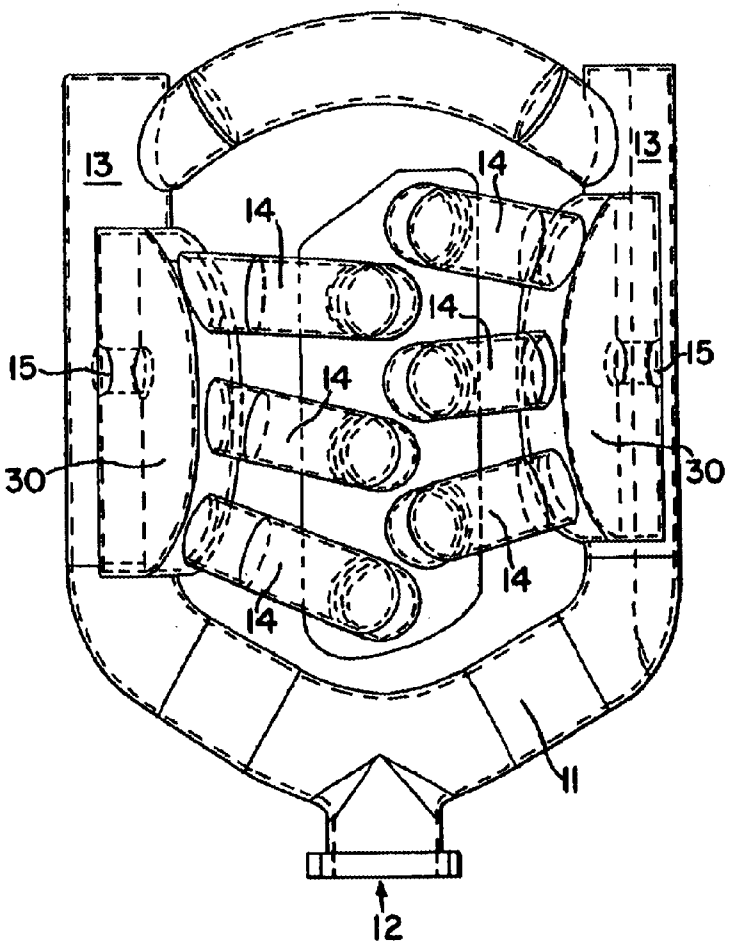
FIG. 5 is a top view of a third embodiment of an intake manifold according to the present invention.

FIG. 5 shows an intake manifold according to a third embodiment of the invention. The intake manifold 10 includes a pair of secondary runners 11 that connect the air inlet 12 to the plena 13. The air inlet 12 is thus in fluid communication with the plena 13. A mixing chamber 30 is attached to and in fluid communication with each plenum 13. Primary runners 14 lead from the mixing chambers 30 to the cylinder heads (not shown). An EGR inlet 15 is located in the wall of each plenum 13.

In operation, air is fed to the intake manifold embodied in FIG. 5 through inlet 12. The amount of airflow into the intake manifold is controlled by a throttle body (not shown) attached to the inlet 12. After entering the inlet 12 the air is routed through the two secondary runners 11 to the plena 13. Once in the plena 13, the air expands to fill mixing chamber 30. The expansion of the air from the plenum 13 into mixing chamber 30 creates an area of low pressure. Exhaust gas is injected into the area of low pressure through EGR inlet 15. The exhaust and fresh air mix in the mixing chamber 30. The mixture of exhaust gas and fresh air is then drawn from the mixing chamber 13 through primary runners 14 and supplied to the appropriate cylinder.

Figure 7:
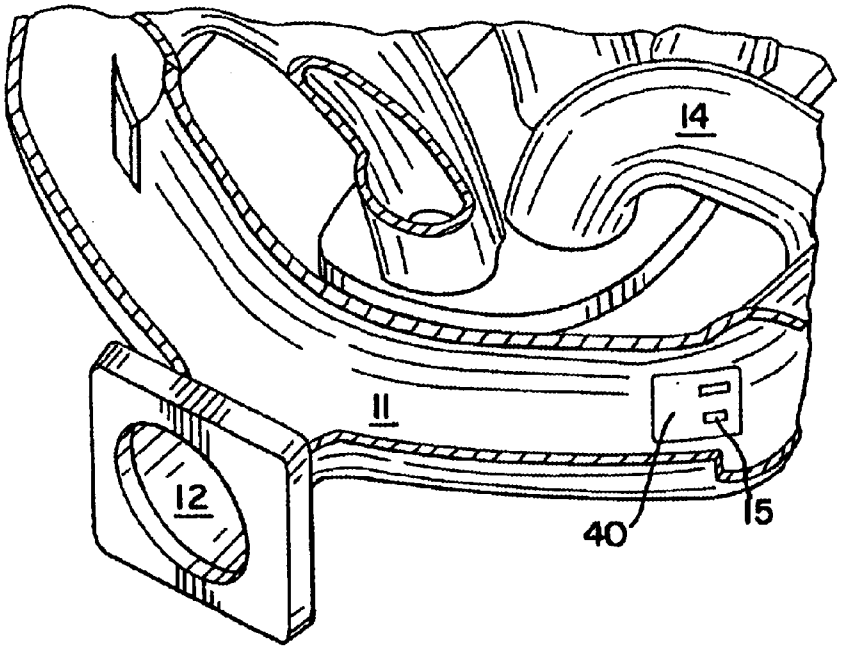
FIG. 7 is a perspective view of a fourth embodiment of an intake manifold according to the present invention.
Figure 6:
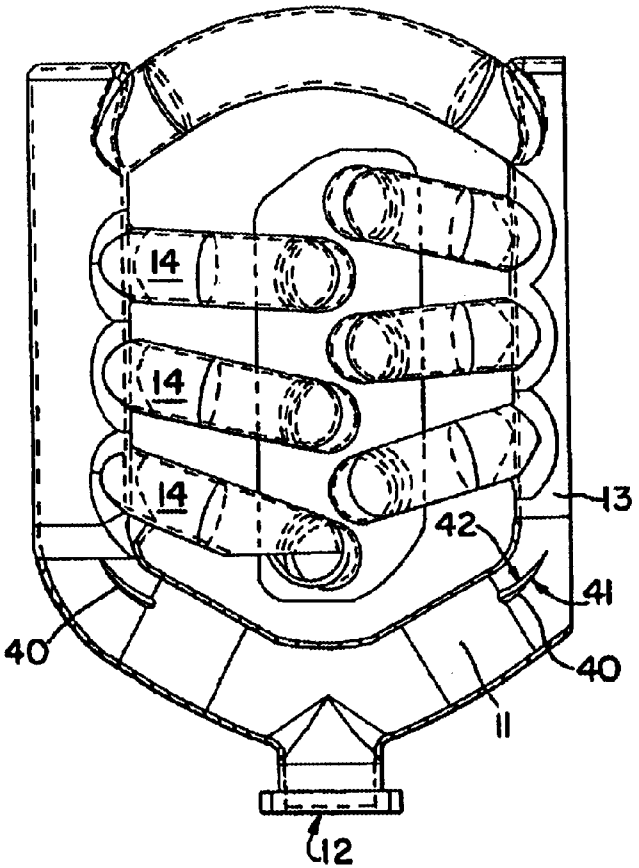
FIG. 6 is a top view of a fourth embodiment of an intake manifold according to the present invention, wherein the top portion of the secondary runners has been cut away.

FIGS. 6 and 7 show an intake manifold according to a fourth embodiment of the present invention. The intake manifold 10 includes a pair of secondary runners 11 that connect the air inlet 12 to the plena 13. Each plenum 13 is thus in fluid connection with the air inlet 12. The plena 13 serve to collect and supply air to the primary runners 14. A series of primary runners 14 connect the plena 13 to the cylinder heads (not shown). In the secondary runners 11 are flow struts 40. Flow struts 40 preferably comprise curved, elongated structures that are centrally located in secondary runners 14. Preferably, flow struts 40 are aerodynamically shaped so as to cause as little disruption to the air flow as possible. In a preferred embodiment, flow struts 40 have a tear-shaped cross-section, with a concave side 42 and a convex side 41. Preferably, flow struts 40 extend the full height of the secondary runner 11. In the preferred embodiment, flow struts 40 are made of stainless steel and are attached in the intake manifold by an isolation fitting. Alternatively, flow struts 40 can be cast with, and constructed of the same material as, the rest of the intake manifold. Flow struts 40 include one or more EGR inlets 15. The EGR inlets 15 are preferably 0.1 inch in diameter. The preferred embodiment shown in FIG. 7 includes two EGR inlets per flow strut 40, however, there may be more or less than two EGR inlets. Preferably the exhaust gas is fed into flow strut 40 and through EGR inlets 15 by EGR tube(s) that enter the manifold from underneath flow strut 40.

In operation, air is fed to the intake manifold embodied in FIGS. 6 and 7 through inlet 12. The amount of airflow into the intake manifold is controlled by a throttle body (not shown) attached to the inlet 12. After entering the inlet 12 the air is routed through the two secondary runners 11. As the air flows through secondary runners 11, the air flows around flow struts 40 and into the plena 13. Exhaust gas is injected into the manifold through EGR inlets 15. The exhaust gas and fresh air are mixed in the secondary runners 11 and flow to the plena 13. The mixture of exhaust gas and fresh air is drawn from the plena 13 through primary runners 14 and supplied to the appropriate cylinder.

An advantage of the embodiments of the first, third, and fourth embodiments is that the exhaust gas is introduced into the intake manifold at a location that is remote from the air inlet 12. One problem associated with EGR systems is that the heat from the exhaust gas has the potential to damage sensitive electronic components, such as throttle bodies, on or near the air inlet for the intake manifold. It is desirable to locate these electronics near the inlet because the air flowing into the manifold through the inlet acts as a heat sink and cools the electronics. If exhaust gas is injected into the intake manifold near the air inlet, the heat from the exhaust gas has the potential to not only counteract the heat sink effect of the incoming fresh air, but also to raise the temperature of the electronic components to an unacceptable level. As a result, there is a possibility that the electronic components can be damaged. Because the intake manifolds of the first, third, and fourth embodiments introduce the exhaust gas away from the inlet, the inlet air can effectively cool the electronics and the heat of the exhaust gas does not damage the electronics.

The design of the EGR tube used to inject exhaust gas into the intake manifold does not limit the scope or application of this invention. By way of example, an EGR tube for use with the first or third embodiment can be an open-ended tube that is inserted through the EGR inlet. In a preferred embodiment, the end of the EGR tube is closed and there are several holes around the perimeter of the tube near the closed-end. This closed-end design aids distribution of the exhaust gas and encourages more turbulent and thorough mixing of the exhaust gas with the fresh air in the manifold.

Of course, it should be understood that a wide range of changes and modifications can be made to the embodiments described above and depicted in the drawings. It is intended, therefore, that the foregoing description illustrates rather than limits this invention, and that it is the following claims, including all equivalents, that define this invention.

What is claimed is:

1. An intake manifold for an internal combustion engine, the manifold comprising:

a. an air inlet;

b. a plenum, the plenum being in fluid communication with the air inlet;

c. a plurality of primary runners, the primary runners being attached to and in fluid communication with the plenum; and, d. an EGR inlet located adjacent each intersection of a primary runner and the plenum.

2. The intake manifold of claim 1 further comprising a secondary runner located between and in fluid communication with the air inlet and the plenum.

3. An intake manifold for an internal combustion engine, the manifold comprising:

a. an air inlet;

b. a plenum, the plenum being in fluid communication with the air inlet;

c. a plurality of primary runners, the primary runners being attached to and in fluid communication with the plenum; and, d. an EGR inlet located at each intersection of a primary runner and the plenum.

4. An intake manifold for an internal combustion engine, the manifold comprising:

a. an air inlet;

b. at least two secondary runners, each secondary runner being adjacent to and in fluid communication with the air inlet;

c. at least two plena, each plenum being adjacent to and in fluid communication with one of the secondary runners;

d. at least two primary runners attached to and in fluid communication with each plenum; and e. an EGR inlet located adjacent each intersection of a primary runner and a plenum.

* * * * *